US012377301B2

(12) United States Patent
Allen, Jr. et al.

(10) Patent No.: US 12,377,301 B2
(45) Date of Patent: Aug. 5, 2025

(54) EXERCISE DEVICE AND METHOD OF USE THEREOF

(71) Applicant: Roger Allen, Jr., Pittsburgh, PA (US)

(72) Inventors: Roger Allen, Jr., Pittsburgh, PA (US); Greg Goeckel, Ofallon, IL (US)

(73) Assignee: Roger Allen, Jr., Pittsburgh, PA (US)

( * ) Notice: Subject to any disclaimer, the term of this patent is extended or adjusted under 35 U.S.C. 154(b) by 161 days.

(21) Appl. No.: 18/472,549

(22) Filed: Sep. 22, 2023

(65) Prior Publication Data

US 2024/0100380 A1 Mar. 28, 2024

Related U.S. Application Data

(60) Provisional application No. 63/377,085, filed on Sep. 26, 2022.

(51) Int. Cl.
*A63B 21/00* (2006.01)

(52) U.S. Cl.
CPC .. *A63B 21/00192* (2013.01); *A63B 21/00069* (2013.01); *A63B 21/4045* (2015.10)

(58) Field of Classification Search
CPC ..... A63B 21/00069; A63B 21/00076; A63B 21/00192; A63B 21/0005; A63B 21/0051; A63B 21/0052; A63B 21/0056; A63B 21/0057; A63B 21/0058; A63B 21/012; A63B 21/015; A63B 21/15; A63B 21/151; A63B 21/22; A63B 21/225; A63B 21/4035; A63B 21/4045; A63B 21/4049; A63B 22/0005; A63B 22/201; A63B 22/203; A63B 23/03533; A63B 23/03541; A63B 23/1209; A63B 23/14; A63B 24/00; A63B 2225/09
See application file for complete search history.

(56) References Cited

U.S. PATENT DOCUMENTS 4,385,760 A * 5/1983 Mattox ..... A63B 21/4045 482/114
4,529,194 A * 7/1985 Haaheim ..... A63B 22/0005 482/70
4,563,004 A * 1/1986 Mattox ..... A63B 21/00069 482/114
9,011,296 B2 * 4/2015 Peralo ..... A63B 23/03575 482/123
2006/0252614 A1 * 11/2006 Rotondale ..... A63B 21/0628 482/99

(Continued)

FOREIGN PATENT DOCUMENTS

CN 113289319 A * 8/2021 ..... A63B 23/12
CN 113616988 A * 11/2021

(Continued)

*Primary Examiner* — Gary D Urbiel Goldner
(74) *Attorney, Agent, or Firm* — K&L Gates LLP

(57) ABSTRACT

An exercise device and a method of use thereof are provided. The exercise device comprises a frame, a track, a handle, and a force control device. The track is operatively coupled to the frame. The handle is slideably engaged with the track and configured to move from a first position relative to the track to a second position relative to the track. The first position and the second position are different. The force control device is configured to adjust an amount of force required to slide the handle along the track.

16 Claims, 18 Drawing Sheets

(56) References Cited

U.S. PATENT DOCUMENTS

| | | | | |
|---|---|---|---|---|
| 2008/0261784 | A1* | 10/2008 | Osbak | A63B 21/4049 482/92 |
| 2009/0239720 | A1* | 9/2009 | Osbak | A63B 21/4035 482/92 |
| 2011/0230315 | A1* | 9/2011 | Castillo | A63B 21/4035 482/94 |
| 2013/0217551 | A1* | 8/2013 | Parnell | A63B 21/00178 482/141 |
| 2013/0303346 | A1* | 11/2013 | Barker | A63B 21/00065 482/129 |
| 2020/0078258 | A1* | 3/2020 | Kanaya | A63B 21/023 |
| 2021/0086025 | A1* | 3/2021 | Carruthers | A63B 22/0005 |
| 2021/0220696 | A1* | 7/2021 | Carruthers | A63B 21/00069 |
| 2024/0335700 | A1* | 10/2024 | Carruthers | A63B 21/225 |

FOREIGN PATENT DOCUMENTS

| | | | | |
|---|---|---|---|---|
| DE | 3343177 | A1 * | 5/1984 | |
| DE | 4418934 | A1 * | 3/1995 | A61H 1/02 |
| WO | WO-8907964 | A1 * | 9/1989 | |

* cited by examiner

EXERCISE DEVICE AND METHOD OF USE THEREOF

CROSS-REFERENCE

This application claims priority to U.S. Provisional Patent Application No. 63/377,085, which was filed on Sep. 26, 2022. The contents of which is incorporated by reference into this specification.

FIELD OF USE

The present disclosure relates to an exercise device and method of use thereof.

BACKGROUND

There are various exercise devices that target different muscle groups, such as, for example, the lower body and the upper body. There are challenges with workout equipment that target the upper body.

SUMMARY

According to one non-limiting aspect of the present disclosure, an exercise device is provided. The exercise device comprises a frame, a track, a handle, and a force control device. The track is operatively coupled to the frame. The handle is slideably engaged with the track and configured to move from a first position relative to the track to a second position relative to the track. The first position and the second position are different. The force control device is configured to adjust an amount of force required to slide the handle along the track.

According to another non-limiting aspect of the present disclosure, the exercise device comprises a frame, a first track, a first handle, a second track, a second handle, a first force control device, and a second force control device. The first track is operatively coupled to the frame. The first handle is slideably engaged with the first track and configured to move from a first position relative to the first track to a second position relative to the first track. The first position and the second position are different. A second handle is slideably engaged with the second track and configured to move from a third position relative to the second track to a fourth position relative to the second track. The third position and the fourth position are different. The first force control device is configured to adjust a first amount of force required to slide the first handle along the first track. The second force control device is configured to adjust a second amount of force to slide the second handle along the second track. The first handle and the second handle are configured to move independently of each other.

According to yet another non-limiting aspect of the present disclosure, a method of using an exercise device is provided as described herein.

It will be understood that the inventions disclosed and described in this specification are not limited to the aspects summarized in this Summary. The reader will appreciate the foregoing details, as well as others, upon considering the following detailed description of various non-limiting and non-exhaustive aspects according to this specification.

BRIEF DESCRIPTION OF THE DRAWINGS

The features and advantages of the examples, and the manner of attaining them, will become more apparent, and the examples will be better understood, by reference to the following description taken in conjunction with the accompanying drawings, wherein.

Corresponding reference characters indicate corresponding parts throughout the several views. The exemplifications set out herein illustrate certain non-limiting examples, in one form, and such exemplifications are not to be construed as limiting the scope of the appended claims in any manner.

DETAILED DESCRIPTION

Various examples are described and illustrated herein to provide an overall understanding of the structure, function, and use of the exercise device. The various examples described and illustrated herein are non-limiting and non-exhaustive. Thus, the invention is not limited by the description of the various non-limiting and non-exhaustive examples disclosed herein. Rather, the invention is defined solely by the claims. The features and characteristics illustrated and/or described in connection with various examples may be combined with the features and characteristics of other examples. Such modifications and variations are intended to be included within the scope of this specification. As such, the claims may be amended to recite any features or characteristics expressly or inherently described in, or otherwise expressly or inherently supported by, this specification. Further, Applicant reserves the right to amend the claims to affirmatively disclaim features or characteristics that may be present in the prior art. The various examples disclosed and described in this specification can comprise, consist of, or consist essentially of the features and characteristics as variously described herein.

There are limited devices available on the market that utilize upper body muscles to achieve a cardiovascular workout. Furthermore, the available devices are typically not capable of working multiple upper body muscle groups and cannot be utilized for other categories of workouts, such as strength training. For example, a standard rowing machine provides a cardiovascular workout, but only provides resistance when the handle is pulled. With such equipment, the group of upper body muscles responsible for the pushing motion are not able to be activated. Additionally, traditional upper body strength training equipment is not designed to provide a cardiovascular workout simultaneously. As such, there is a need for cardiovascular-exercise focused equipment that is able to utilize more upper body muscles In light of these issues, the present disclosure provides an exercise device and a method of use thereof as described herein.

Figure 1A:
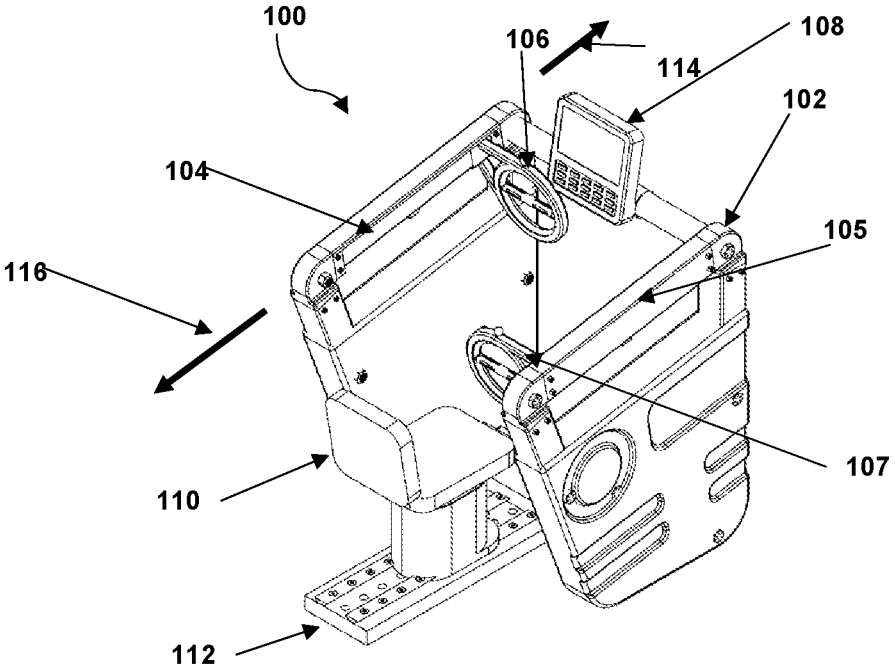
FIG. 1A illustrates a schematic perspective view of an exercise device according to the present disclosure in a first configuration.

Referring to FIG. 1A, an example of an exercise device 100 is provided. The exercise device 100 can be used for cardiovascular training, strength training, and/or other fitness routines for the upper body. The exercise device 100 is configured to provide resistance in a first direction 114 (e.g., a push) and a second direction 116 (e.g., a pull) to activate the upper body muscle groups of an operator in at least two directions of motion. The exercise device 100 comprises a frame 102, a track 104 operatively coupled to the frame 102, a handle 106 slideably engaged with the track 104, and a force control device (e.g., force control device 500 as shown in FIG. 5) configured to adjust an amount of force required to slide the handle 106 along the track 104.

Figure 1B:
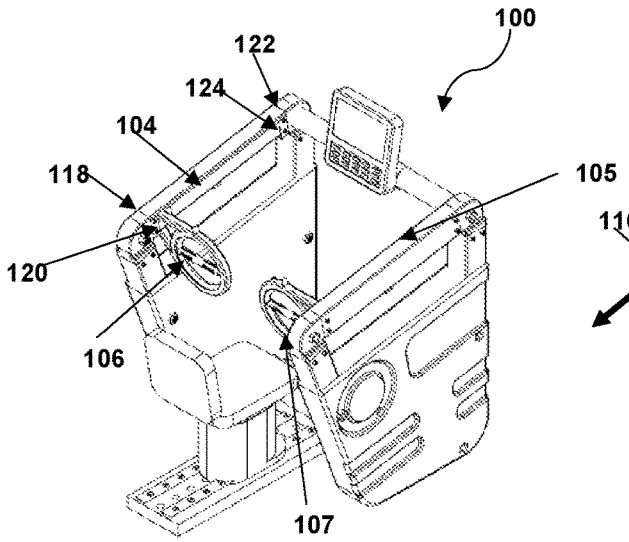
FIG. 1B illustrates a schematic perspective view of the exercise device of FIG. 1A in a second configuration.
Figure 1C:
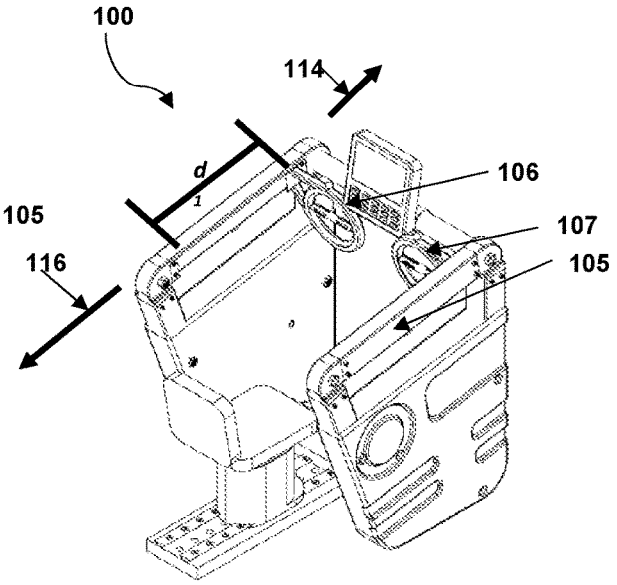
FIG. 1C illustrates a schematic perspective view of the exercise device of FIG. 1A in a third configuration.

The handle 106 is slideably engaged to the track 104 and configured to move from a first position relative to the track 104 as shown in FIG. 1B to a second position relative to the track 104 as shown in FIG. 1C. The first position is different than the second position. An operator can exert a force in the first direction 114 on the handle 106 to urge the handle 106 from the first position as illustrated in FIG. 1B towards the second position as illustrated in FIG. 1C. The operator can exert a force on the handle 106 in the second direction 116 (e.g., pull) to urge the handle 106 from the second position as illustrated in FIG. 1C towards the first position as illustrated in FIG. 1B. The first and second positions are illustrative of various examples, and it is understood the first and second positions can be positioned at various other locations along the track 104 as long as the first position and the second position are different. Movement of the handles 106, 107 between the first position in FIG. 1B and the second position as illustrated in FIG. 1C can be linear.

A stroke length is a distance, $d_1$, between the first position and the second position. The stroke length and corresponding first position and second position, can be variable between different operators or between different strokes of an operator. For example, an individual with a shorter wingspan may have a shorter maximum stroke length, $d_1$, than an individual with a larger wingspan. The distance that the individual with the larger wingspan may be able to urge the handle 106 along the track 104 from the first position to the second position may be greater than the individual with the shorter wingspan.

In various examples, a first end 118 of the track 104 can comprise a bumper 120 that prevents the handle 106 from moving beyond a predetermined threshold (e.g., beyond the first end 118 of the track 104). In various examples, a second end 122 of the track 104 can comprise a bumper 124 that prevents the handle 106 from moving beyond a predetermined threshold (e.g., beyond the second end 122 of the track 104). Limiting the movement of the handle 106 can prevent damage to the exercise device 100 and/or harm to the operator.

Figure 2:
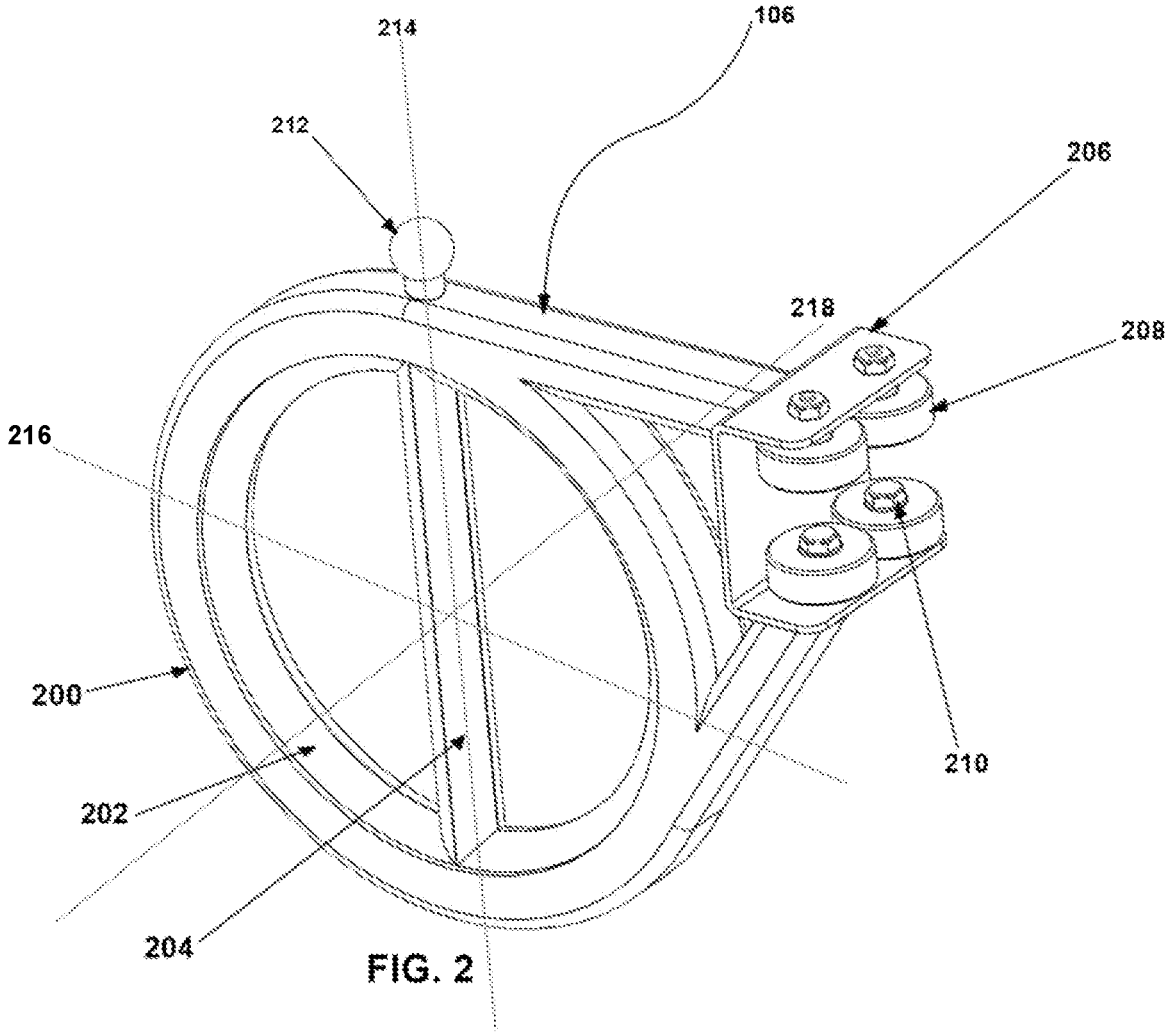
FIG. 2 illustrates a detailed view of the handle of FIG. 1A.

Referring now to FIG. 2, a detailed view of the handle 106 is provided. The handle 106 comprises a bracket 206. In various examples, the bracket 206 may be formed from the same material as the swivel handle frame 200, such that the bracket 206 and the swivel handle frame 200 originate from a singular piece of material. In certain examples, the bracket 206 may be fixed to the swivel handle frame 200 by a fastener (e.g., a bolt, a screw, a rivet, a nut, a snap fit, a pin), an adhesive (e.g., a glue), or a combination thereof.

In various examples, the bracket 206 can contain roller wheels 208, each of which can comprise a bearing 210. The bearings 210 and roller wheels 208 can be rotatably attached to the bracket 206 by a fastener. The bracket 206 and the roller wheels 208 can be aligned to fit into the extrusion of the track 104, such that the roller wheels 208 are sufficiently hidden inside the track 104, which can eliminate pinch points along the exercise device 100. In other examples, the bracket 206 may not contain roller wheels 208. In such examples, the bracket 206 may be in direct contact with the track 104.

The roller wheels 208 may be made out of any material where the amount of friction between the roller wheels 208 and the track 104 is reduced to enhance sliding of the handles 106 and 107. For example, the roller wheels 208 can comprise urethane.

The handle 106 can comprise a swivel handle frame 200 and an inner handle loop 202. In certain examples, the inner handle loop 202 may snap inside the swivel handle frame 200 such that the inner handle loop 202 requires no additional fastening method or locking pin 212 to remain in place within the swivel handle frame 200. In various examples, the inner handle loop 202 can be concentric and rotatably engaged with the swivel handle frame 200 such that the inner handle loop 202 is able to rotate along axis 218 of the swivel handle frame 200. The inner handle loop 202 may be fixed to the swivel handle frame 200 using a locking pin 212 or other fastener type.

The inner handle loop 202 can comprise a handle bar 204. In various examples, the inner handle loop 202 and the handle bar 204 are permanently attached to each other. In such examples, the inner handle loop 202 and the handle bar 204 may be formed from the same material, such that the inner handle loop 202 and the handle bar 204 originate from a singular piece of material. In various examples, the handle bar 204 may be fixed to the inner handle loop 202 by a fastener, an adhesive, or a combination thereof.

The handle 106 may be configured to operate in various configurations. To change the orientation of the handle bar 204 relative to the track 104, the locking pin 212 can be lifted out of the lowered position (e.g., the position in which the locking pin 212 interferes with the swivel handle frame 200) and raised such that the locking pin 212 may no longer interfere with the swivel handle frame 200. Upon lifting the locking pin 212 such that the locking pin 212 no longer interferes with the swivel handle frame 200, the orientation of the handle bar 204 relative to the track 104 can be adjusted. In various examples, upon removing the locking pin 212, the inner handle loop 202 can be rotated such that the handle bar 204 is placed in a vertical position (e.g., the position in which the handle bar 204 is aligned with the vertical axis 214), and the locking pin 212 can be replaced to ensure that the handle bar 204 remains in position during use of the exercise device 100 as shown in FIG. 2B. In various examples, upon removing the locking pin 212, the inner handle loop 202 can be rotated such that the handle bar 204 is placed in the horizontal position (e.g., the position in which the handle bar 204 is aligned with the horizontal axis 216), and the locking pin 212 can be replaced to ensure that the handle bar 204 remains in position during use of the machine. In various examples, the locking pin 212 can be removed such that, when the operator urges the handle 106 in the first direction 114 or urges the handle 106 in the second direction 116 using the handle bar 204, the inner handle loop 202 is able to freely rotate within the swivel handle frame 200 around the central axis 218.

In various examples, the handle 106 may not include a separate inner handle loop 202 and the handle bar 204 may be directly attached to the swivel handle frame 200. The handle bar may be oriented in any direction along the central axis 218.

In various examples, the handle bar 204 may include sensors. For example, one type of sensor that may be connected to the handle bar 204 is a heart rate sensor which may be capable of reading the heart rate of the operator during their workout and presenting the information on a display of a hardware control device 108. The handle bar 204 may house the electronics necessary to power and sense heart rate including, but not limited to, batteries, wires, and any other necessary components.

In various examples, referring to FIG. 1, the exercise device 100 can comprise two handles 106 and 107 on each side of the frame 102 slideably engaged with a respective track 104 or 105. The handle 106 and the handle 107 can be configured to operated independently of each other. The handle 106 and the handle 107 can be mirror images of one another and configured in a similar manner. In certain examples, the handles 106 and 107 may be different. The track 104 and the track 105 can be mirror images of one another and configured in a similar manner. In certain examples, the tracks 104 and 105 may be different. The tracks 104 and 105 can be linear.

Figure 3A:
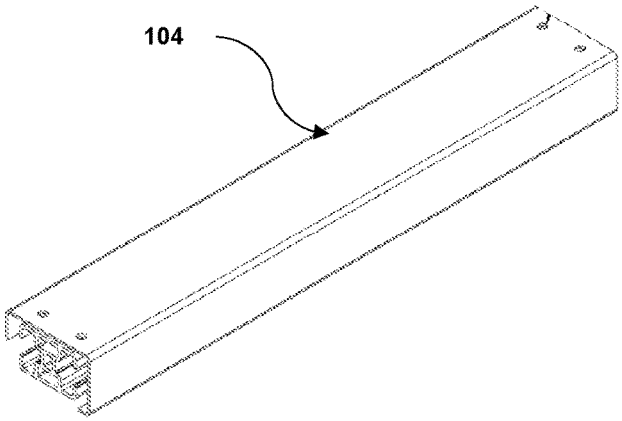
FIG. 3A illustrates a detailed view of the track of FIG. 1A.
Figure 3B:
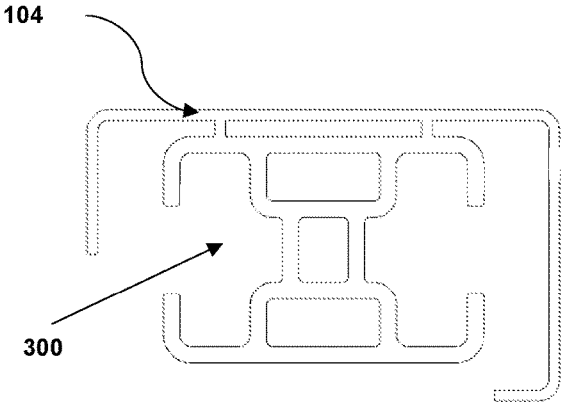
FIG. 3B illustrated a detailed front view of the track of FIG. 3A.

FIG. 3 depicts a detailed view of the track 104, which is operatively coupled to frame 102. The track 104 can comprise holes to suitable to receive a fastener in order to attach the track 104 to the frame 102.

In various examples, the track 104 may be manufactured by extruding an internal cavity 300 that allows the roller wheels 208 and the bracket 206 to engage and slide with minimal resistance. The internal cavity 300 can be sized and configured to allow the roller wheels 208 of the handle 106 to freely slide along the track 104 with minimal resistance and prevent the roller wheels 208 and bracket 206 from falling off of the track 104 or causing the handle 106 to excessively wobble.

Figure 4:
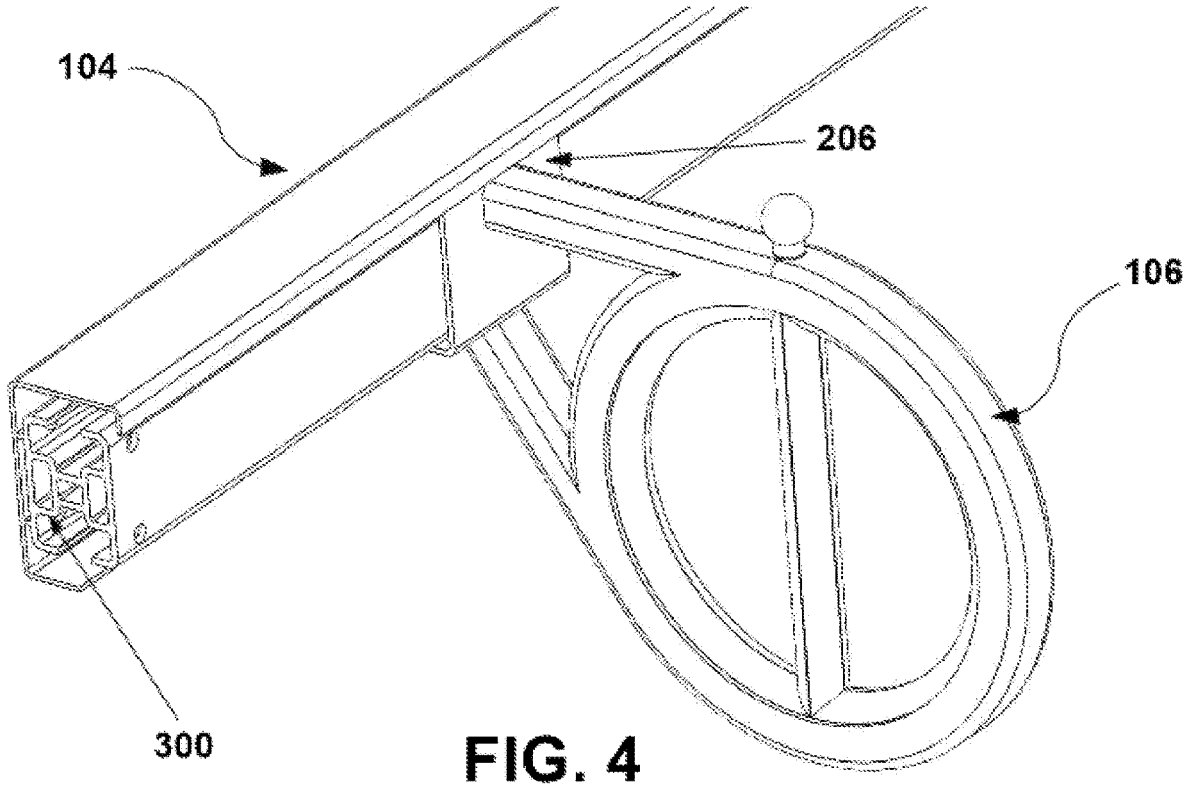
FIG. 4 illustrates a schematic perspective view of the handle and the track of FIG. 1A.

FIG. 4 depicts a schematic of the handle 106 slideably engaged with the track 104. The bracket 206 and the roller wheels 208, which are fixed to the handle 106, can fit within the internal cavity 300 of the track 104, such that the handle 106 can slide along the surface of the track 104.

Figure 7A:
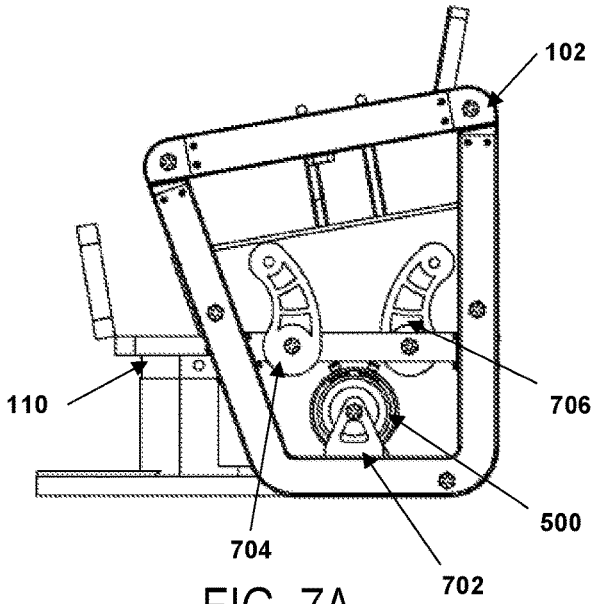
FIG. 7A illustrates a schematic side view of the exercise device of FIG. 1A with certain components hidden removed to illustrate the magnetic resistance assembly.
Figure 7B:
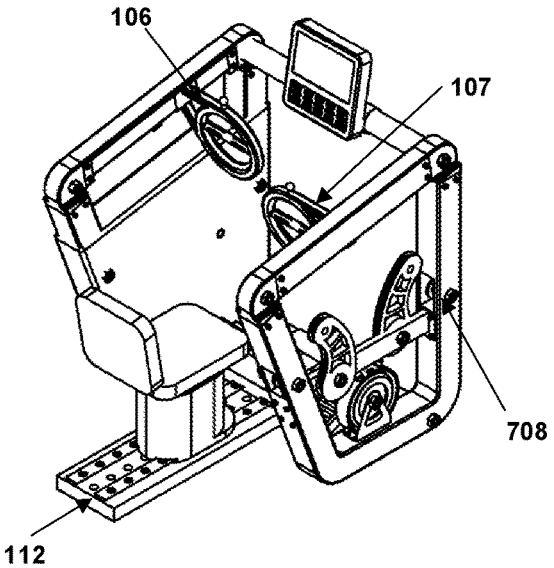
FIG. 7B illustrates a schematic perspective view of the exercise device of FIG. 7A.
Figure 7C:
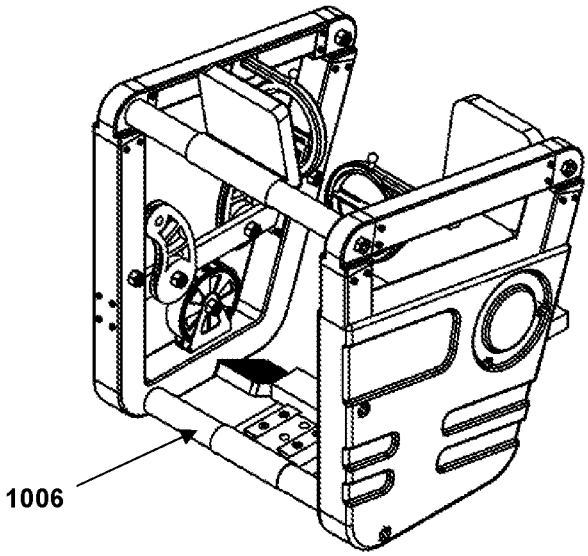
FIG. 7C illustrates a schematic rear perspective view of the exercise device of FIG. 7A.

Referring to FIGS. 7A-7B, the force control device 500 is shown attached to the frame 102 using a bracket 702. The bracket 702 can be fixed to the frame using a fastener or a weld. The force control device 500 can be attached to the bracket 702 along the central axis 524 of the force control device 500. In various examples, the force control device 500 contains components arranged along the central axis 524 of the force control device 500 which may need to freely rotate, such as a flywheels 502 and 504. The bracket 702 may be connected to the assembly housing 514 such that the assembly housing 514 may be stationary while the rotating components, such as the flywheels 502 and 504, are able to rotate.

For example, in the force control device 500, the assembly housing 514 may be attached to the bracket 702 along the central axis 524 of the assembly housing 514. The assembly housing 514 can also contains a rod through the central axis 524. The flywheels 502 and 504 can be rotationally engaged with a rod, such that the flywheels 502 and 504 are able to freely turn along the central axis 524 of the force control device 500. In various examples, the back end of the rod which engages with the assembly housing 514 and a hole in the assembly housing 514 may be threaded such that the rod and the assembly housing 514 may be secured together using the threads. Further, the interior diameter of the rod may be threaded such that the rod, and in turn the assembly housing 514, may be secured to the bracket 702, and in turn the frame 102 through the bracket 702 and the rod. The assembly housing 514 and the rod may be more stable and experience minimal movement during operation of the exercise device 100.

Figure 5A:
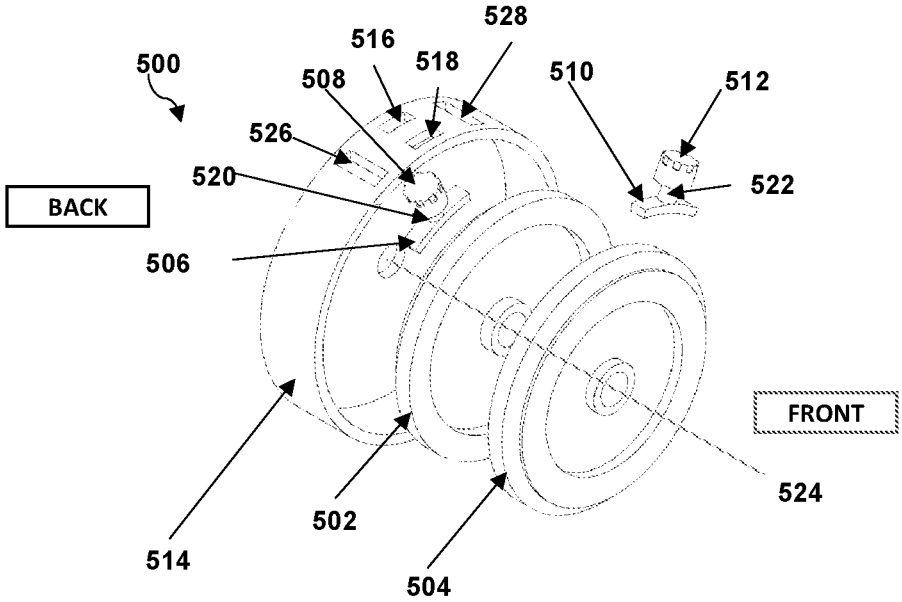
FIG. 5A illustrates an exploded detail view of the magnetic resistance assembly of FIG. 7A.

In further reference to FIGS. 7A-7B, the resistance generated by the force control device 500 can be translated to the respective handle 106, 107. The assembly housing 514 of the force control device 500 may contain cable slots 516 and 518 as shown in FIG. 5A. In various examples, referring to FIGS. 12-13, a moveable force translation device 1280, such as, for example, a cable, a belt, and/or a chain, may be wrapped around one of flywheels 502 and 504 and fed through the cable slots 516 and 518. The moveable force translation device 1280 can be configured to translate force from the respective force control device 500 to the respective handle 106, 107. For example, the moveable force translation device 1280 can be mechanically coupled to one of the force control devices 500 and one of the handles 106, 107.

Figure 12:
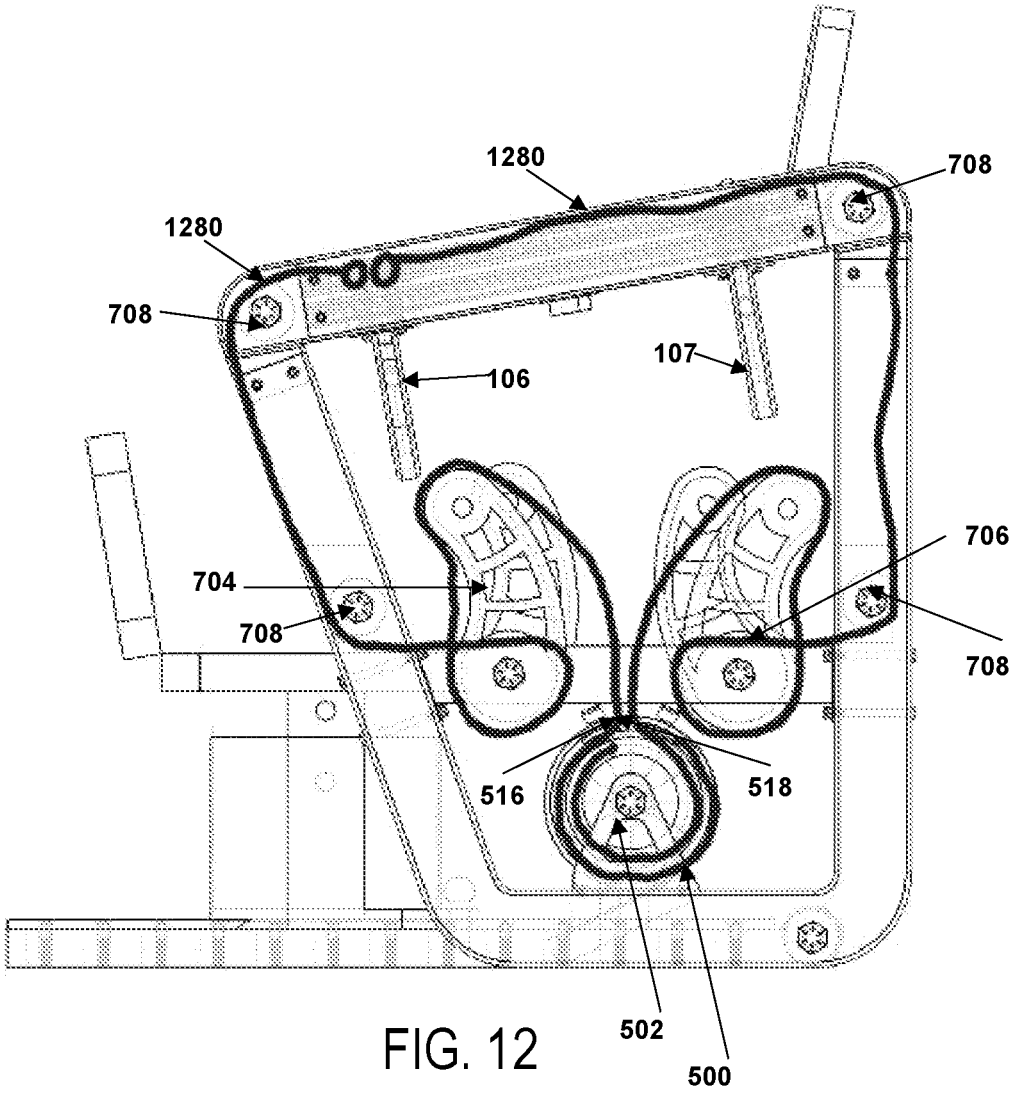
FIG. 12 is a side view of an exercise device according to the present disclosure shown with moveable force translation devices.
Figure 13:
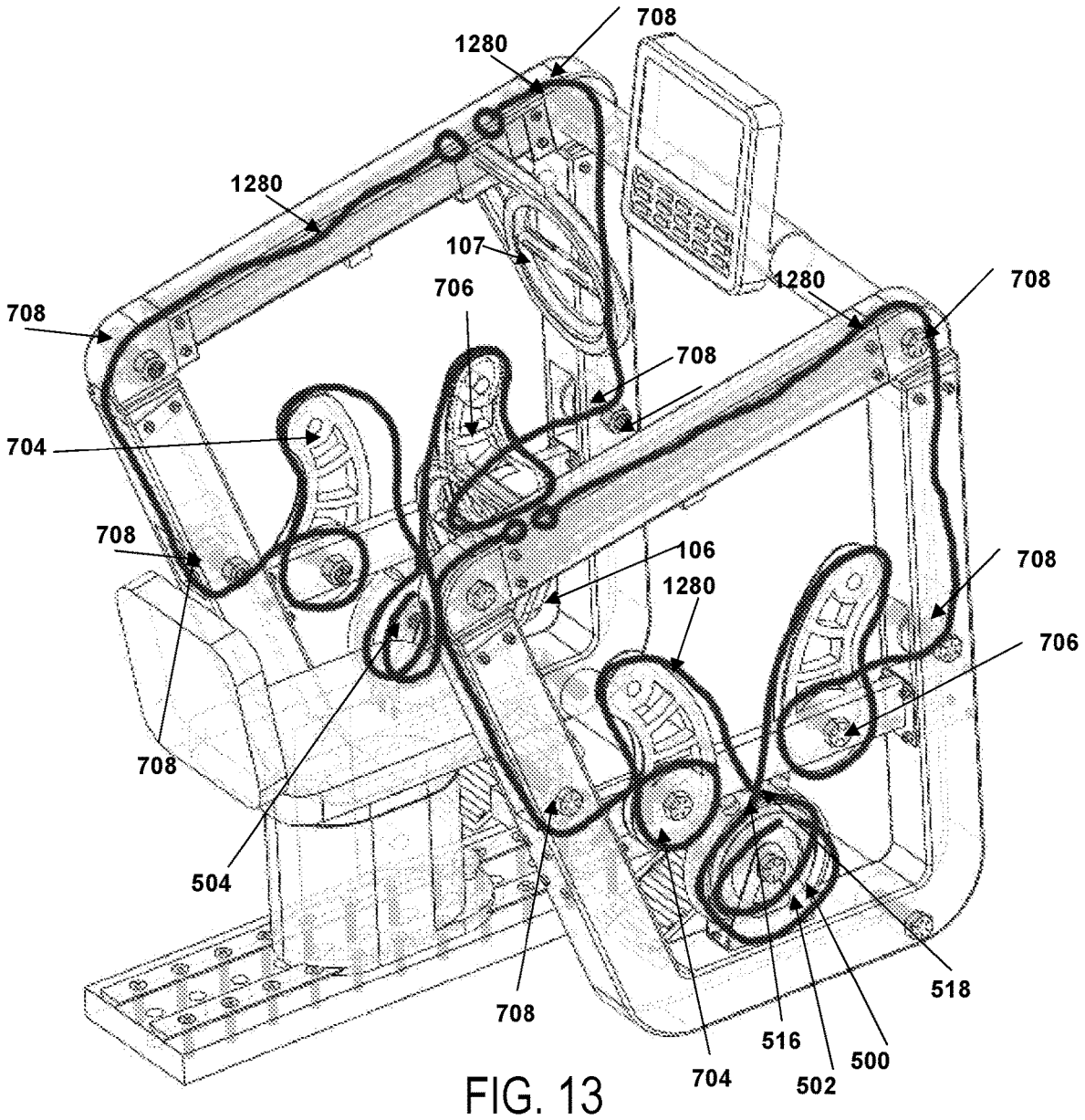
FIG. 13 is a perspective view of the exercise device of FIG. 12.

As illustrated in FIG. 12, two moveable force translation devices 1280 are shown in FIGS. 12-13 connected to the flywheel 502 to generate resistance for handle 106. The two moveable force translation devices 1280 can be configured to generation resistance in different directions. For example, one moveable force translation device 1280 can generate force when the handle 106 is moved in the first direction 114 and a second moveable force translation device can generate force when the handle is moved in the second direction 116.

As illustrated in FIG. 13, there are a plurality of moveable force translation devices 1280 with a first set of two of the moveable force translation devices 1280 configured to translate force from the flywheel 502 of a force control device 500 to the handle 106 and a second set of two of the moveable force translation devices 1280 configured to translate force from the flywheel 504 of a force control device 500 to the handle 107.

Referring to FIGS. 12-13, the moveable force translation device 1280 may then be wrapped around cams 704 and 706 and/or pulley 708, which is then connected to the respective handle 106, 107 such that the output of the force control device 500 is translated to the respective handle 106, 107. In various examples, the moveable force translation device 1280 may be directly connected to the respective handle 106, 107 from the flywheels 502 and 504 without using any cams 704, 706 and/or pulleys 708.

Figure 5B:
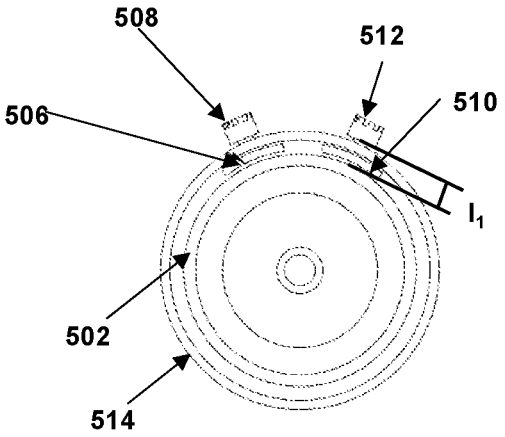
FIG. 5B illustrates a front detail view of the magnetic resistance assembly of FIG. 7A.
Figure 5C:
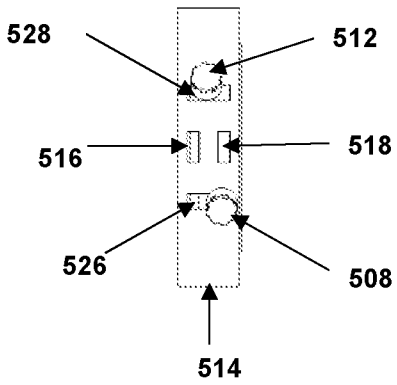
FIG. 5C illustrates a side detail view of the magnetic resistance assembly of FIG. 7A.

Referring to FIGS. 5A-5C, the force control device 500 is configured to adjust an amount of force required to slide the handle 106 along the track 104. By adjusting the amount of force required to slide the handle 106 along the track 104, the force control device 500 can allow the operator to vary the difficulty and/or type of workout they perform. In various examples, the force control device 500 may comprise a magnetic resistance assembly, a friction control assembly, a spring, or an alternative and/or combination thereof.

In various examples, the force control device 500 may comprise one or more magnetic resistance assemblies. The magnetic resistance assembly can comprise an assembly housing 514, a magnet 506, and a flywheel 502. The flywheel 502 is attached to the assembly housing 514 using a rod located along the central axis 524 of both the flywheel 502 and the assembly housing 514. The rod is fixed to the assembly housing 514 such that both the rod and the assembly housing 514 are stable at all times. The flywheel 502 is rotationally engaged with the rod such that the flywheel 502 is able to spin freely along its central axis 524.

Figure 6:
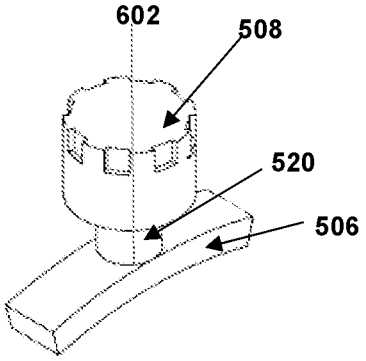
FIG. 6 illustrates the motor, the spindle, and the magnet of FIG. 5A.

In various examples, the force control device 500 may comprise a motor 508 and a spindle 520. FIG. 6 depicts the motor 508 connected to the magnet 506 and spindle 520. In various examples, the magnet is operatively coupled to the spindle 520. The spindle 520 is operatively coupled to the motor along the central axis 602 of the motor 508 and the spindle 520. In various examples, the top of the spindle 520 may be threaded to engage with a threaded hole in the motor 508, such that when the motor 508 turns, the length of the spindle 520 increases. Changing the length of the spindle 520 by turning the motor 508 can change the distance between the motor 508 and the magnet 506, as well as the distance between the magnet 506 and the flywheel 502. As depicted in FIG. 5B, the spindle 520 may not exceed a length, $l_1$, such that the magnet 506 and the flywheel 502 do not touch.

FIGS. 5A-5C depict the motor 508, magnet 506, and spindle 520 assembly attached to the assembly housing 514 through the motor slots 526 and 528. The spindle 520 is fed through the motor slot 526 and the motor 508 is placed concentrically on the spindle 520 along the central axis 602 of the spindle 520 and the motor 508. The width of the motor slot 526 is narrower than the diameter of the motor 508 but wider than the diameter of the spindle 520 such that the motor 508 may not slip through the motor slot 526 and the spindle 520 can be fed through the motor slot 526 to engage with the motor 508. The motor slots 526 and 528 can be long enough that the assembly housing 514 contains more than one assembly (i.e., there are more than one flywheel, more than one magnet, more than one spindle, and/or more than one motor within the assembly housing 514), the magnets 506 and 510 may be placed out of alignment with each other. Each magnet 506 and 510 can interact with one of flywheels 502 and 504, so the location of the respective magnet 506, 510 along the motor slot 526, 528 will be determined by the location of the corresponding flywheel 502, 504 along the central axis 524 within the assembly housing 514.

The force control device 500 depicted in FIGS. 5A-5C is configured to adjust an amount of force required to slide the handle 106 along the track 104. The magnetic resistance assembly comprises a magnet 506 and a flywheel 502, wherein a gap is present between the magnet 506 and the flywheel 502. The gap can create magnetic resistance to control the amount of force required to slide the handle 106 along the track 104. The magnetic resistance of the flywheel 502 can be controlled by adjusting the distance between the magnet 506 and the flywheel 502 using the motor 508 on a spindle 520. The closer the magnet 506 is to the flywheel 502 (e.g., the smaller the gap between the magnet 506 and the flywheel 502), the more resistance there is for the flywheel 502 to spin. The further the magnet 506 is from the flywheel 502 (e.g., the larger the gap between the magnet 506 and the flywheel 502), the less resistance there is for the flywheel 502 to spin. Because the flywheel 502 can be connected to the handle 106 using the moveable force translation device 1280, the increase in resistance for the flywheel 502 to spin can result in an increase in the amount of force to urge the handle 106 along the track 104, thereby increasing the difficulty of the exercise being performed. Similarly, a decrease in the amount of resistance for the flywheel 502 to spin will result in a decrease in the amount of force required to urge the handle 106 along the track 104, thereby decreasing the difficulty of the exercise being performed.

In various examples, the assembly housing 514 may contain two magnetic resistance assemblies, a first assembly and a second assembly. The first assembly can comprise the magnet 506, the motor 508, the spindle 520 and the flywheel 502. The second assembly can comprise the magnet 510 the motor 512, the spindle 522, and the flywheel 504. One of the assemblies may control the amount of force required to urge the handle 106 from the first position to the second position in the first direction 114 and the other assembly may control the amount of force required to urge the handle 106 from the second position to the first position in the second direction 116.

The flywheel 502 and the flywheel 504 should be placed on the rod with the central axis 524 of both flywheels 502, 504 and the central axis 524 of the rod in alignment (e.g., the plane along the face of both flywheels 502, 504 are parallel to each other). In various examples, a spacer may be placed between the flywheels 502 and 504 to prevent them from touching during operation. The magnet 506 can be aligned with the flywheel 502 and the magnet 510 can be aligned with the flywheel 504, as shown in FIG. 5A. The surface of the magnet 506 proximal to the flywheel 502 can be concentric with the outer surface of the flywheel 502 and the surface of the magnet 510 proximal to the flywheel 504 can be concentric with the outer surface of the flywheel 504. The spindle 520 and the motor 508 can be located in the motor slot 526 such that the motor 508 is placed toward the back of the motor slot 526 and the magnet 506 can be aligned with the flywheel 502. The spindle 522 and the motor 512 can be placed in the motor slot 528 such that the motor 512 is placed toward the front of the motor slot 528 and the magnet 510 can be aligned with the flywheel 504.

The flywheel 502 and the flywheel 504 can be connected to separate, independent moveable force translation devices 1280. One of the moveable force translation devices 1280 should wrap around the flywheel 502 and exit the force control device 500 through the cable slot 516. A second of the moveable force translation devices 1280 should wrap around the flywheel 504 and exit the force control device 500 through the cable slot 518. The first force control device may wrap around the cam 704 and then attach to the handle 106. The second force control device may wrap around the cam 706 and then attach to the handle 107.

In various examples, wherein the force control device 500 is a magnetic resistance assembly, the flywheel can comprise a magnetic material such as, for example, steel. In various examples, wherein the force control device 500 is not a magnetic resistance assembly, the flywheels 502 and 504 may not need to be magnetic and can comprise plastic, a metal, a metal alloy, a composite, or any combination thereof.

In various examples, each side of the exercise device may contain at one or more force control devices 500, such that each handle 106 and 107 can be urged along the separate tracks 104 and 105 independently. The force control device for each handle 106 and 107 can enable the amount of resistance generated by the force control device 500, and in turn the amount of force required to urge the respective handle 106, 107 along the corresponding track 104 or 105 to be independently determined by the operator for each handle 106, 107. For example, the operator can configure the exercise device 100 such that the handle 106 requires more force to be urged down the track 104 than the handle 107 down the second track 105 by altering the force control device 500, which is connected to the handle 106, to have a higher resistance than a second force control device, which is connected to the handle 107. Similarly, the operator can configure the exercise device 100 such that the handle 107 requires more force to be urged down the track 105 than the handle 106 down the track 104 by altering the second force control device, which is connected to the handle 107, to have a higher resistance than the force control device 500, which is connected to the handle 106.

In various examples, the force control device 500 can be a spring resistance assembly. In such examples, the spring resistance assembly may comprise a spring, a handle connector, an end connector, and a torsion dial. The spring resistance assembly may be embedded within the track 104. The end connector may be secured directly to the inside of the track using any fastener such as, but not limited to, a bolt. The end connector may also be secured to one end of the spring using any fastener. The other end of the spring may be secured to the handle connector. The handle connector may be connected to the handle 106, 107. In such examples, the spring may be fed through the torsion dial such that when the torsion dial is turned, the spring may compress or expand, thereby changing the resistance in the spring. Thus, if the torsion dial is turned in one direction, the spring may compress and the resistance in the spring would increase, thereby making it more difficult to urge the handle 106 along the track 104. If the torsion dial is turned in the opposite direction, the spring may expand and the resistance in the spring would decrease, thereby making it easier to urge the handle 106 along the track 104.

In various examples wherein the force control device 500 comprises a spring resistance assembly, each side of the exercise device may comprise two spring resistance assemblies, such that the first spring resistance assembly may control the amount of force required to urge the handle 106 along the track 104 from the first position to the second position in the first direction 114. The second spring resistance assembly may control the amount of force required to urge the handle 106 along the track 104 from the second position to the first position in the second direction 116. The amount of force required to move the handle in the first direction 114 or pull the handle 106 in the second direction 116 can be the same or different.

In various examples, the force control device 500 can be a friction resistance assembly. In such examples, the amount of force required to urge the handle 106 along the track 104 may be dependent on the frictional resistance between the handle 106 and the track 104. In various examples, the friction resistance assembly may comprise a friction device, wherein the friction device can create varying levels of friction between the handle 106 and the track 104, such that the more friction is created between the handle 106 and the track 104, the more difficult it may be to urge the handle 106 along the track 104. Similarly, the less friction created between the handle 106 and the track, the less difficult it may be to urge the handle 106 along the track 104. The friction device may be operatively coupled to the track using any fastener including, but not limited to, a bolt.

In various examples, the force control device 500 may be a combination of force control assemblies such as, but not limited to, the magnetic resistance assembly, the spring control assembly, and/or the friction control assembly. For example, the force control device used to control the amount of force required to urge the handle 106 along the track 104 from the first position to the second position in the first direction 114 may be a magnetic resistance assembly, and the force control device used to control the amount of force required to urge the handle 106 from the second position to the first position in the second direction 116 may be a spring resistance assembly. These examples are not limited to the combinations described herein; any combination of force control devices 500 may be used to control the amount of force required to urge the handle 106 along the track 104.

In various examples, the amount of force required to slide the handle 106 along the track 104 may be adjustable based upon operator input. The operator may manually adjust the amount of force required by altering the force control device 500. For example, if the force control device 500 was a magnetic resistance assembly, the operator could manually adjust the distance between the magnet 506 and the flywheel 502, such that the gap between them is changed to create the operator's optimal level of resistance. The operator may also adjust the gap between the magnet 506 and the flywheel 502 by directly turning the motor 508 which is located outside of the assembly housing 514, which can inhibit potential damage to the magnetic resistance assembly.

The hardware control device 108 may be secured to the frame 102. The amount of force to slide the handle 106 along the track 104 may be adjustable based on operator input using the hardware control device 108. In certain examples, the amount of force to slide the handle 106 along the track 104 can be manually controlled. The hardware control device 108 can include a buttons, a display, a processor operatively coupled to memory and other circuitry configured to perform the functions of the exercise device 100. The hardware control device 108 can be in signal communication with various sensors and the motors 508 and 512.

The hardware control device 108 can activate the motors 508 and 512 such the motors 508 and 512 can moves their respective magnet 506 or 510 relative to the corresponding flywheel 502 or 504 to adjust a gap between the respective magnet 506 or 510 and the corresponding flywheel 502 or 504. The gap between the respective magnet 506 or 510 and the corresponding flywheel 502 or 504 can affect the amount of force required to move the flywheel 502 or 504 and therefore slide the handle 106 or 107 along the respective track 104 or 105.

In reference to FIGS. 8A through 8D, the exercise device 100 can comprise a seat 110. The seat 110 can be operatively coupled to the frame 102. The seat 110 can be positioned such that a operator sitting in the seat 110 can urge the handles 106, 107 from the first position as illustrated in FIG. 1B to the second position as illustrated in FIG. 1C with a press motion.

Figure 8A:
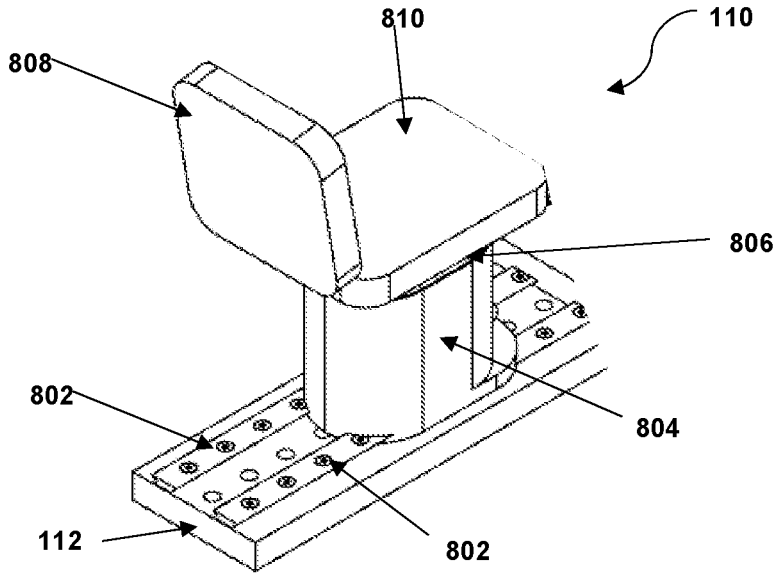
FIG. 8A illustrates a schematic perspective view of the seat of FIG. 1A.
Figure 8B:
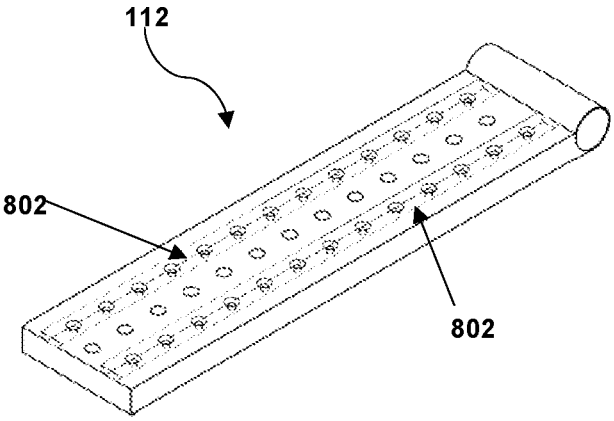
FIG. 8B illustrates a schematic perspective view of the bottom seat floor platform of FIG. 8A.
Figure 8C:
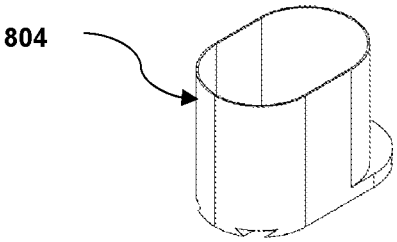
FIG. 8C illustrates a schematic perspective view of the sliding seat base bottom of FIG. 8A.

The seat 110 may comprise a bottom seat floor platform 112, a sliding seat base bottom 804, an upper seat base 806, a back cushion 808, and a bottom cushion 810. The bottom seat floor platform 112 may be secured to the frame 102. In various examples, the sliding seat base bottom 804 may be slideably engaged with the bottom seat floor platform 112 such that the slots within the sliding seat base bottom 804 match the rails 802 along the bottom seat floor platform 112, as shown in FIG. 8A through 8C. The rails 802 and the slots in the sliding seat base bottom 804 may be sized and configured such that the profile of the rails 802 substantially matches the profile of the slots in the sliding seat base bottom 804. For example, the rails 802 may be v-shaped and the slots in the sliding seat base bottom 804 can be sized and configured to substantially match the v-shape of the rails 802. In various examples, the rails 802 may contain holes, as depicted in FIG. 8B. Additionally, the sliding seat base bottom 804 may contain a locking mechanism, such that the locking mechanism of the sliding seat base bottom 804 can engage with the holes in the rails 802. The operator can adjust the position of the seat 110 relative to the frame 102 by sliding the sliding seat base bottom 804 along the bottom seat floor platform 112 using the rails 802. When the operator has reached their preferred seat 110 positon relative to the frame 102, the locking mechanism on the sliding seat base bottom 804 can be positioned such that it engages with one of the holes on the rails 802, thereby preventing further movement of the sliding seat base bottom 804 and, in turn, the seat 110.

Figure 8D:
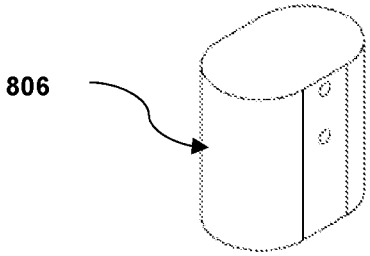
FIG. 8D illustrates a schematic perspective view of the upper seat base of FIG. 8A.

In various examples, the upper seat base 806 may be slideably engaged with the sliding seat base bottom 804 such that the upper seat base 806 can be adjusted to raise and/or lower the height of the seat 110. In various examples, the upper seat base 806, as shown in FIG. 8D, and the sliding seat base bottom 804 may have holes to accommodate a locking pin. In such examples, the upper seat base 806 may be raised or lowered within the sliding seat base bottom 804 until a operator's preferred seat 110 height is reached. The locking pin may then be placed in the holes of the upper seat base 806 and the sliding seat base bottom 804 such that the seat 110 remains at the desired height until the locking pin is removed.

In various examples, the back cushion 808 and the bottom cushion 810 may be secured to the upper seat base 806. The back cushion 808 and the bottom cushion may be made of any solid material such as, but not limited to, metal, metal alloy, plastic, and/or any combination thereof. To improve the comfort of the operator, the back cushion 808 and the bottom cushion 810 may also be include a soft material such as, but not limited to, cotton and/or fabric.

Figure 9:
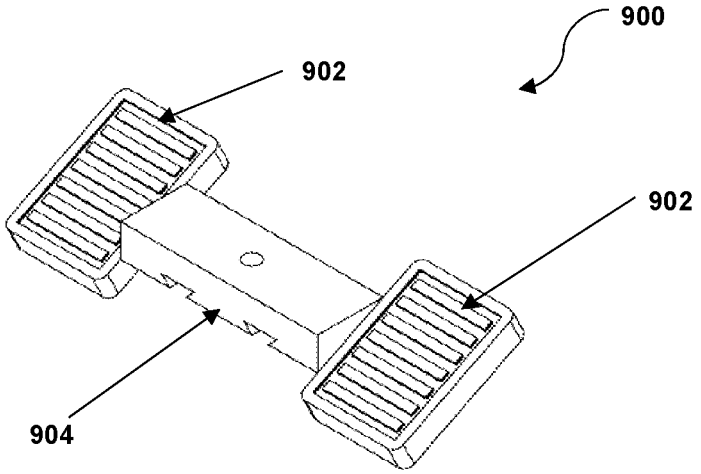
FIG. 9 illustrates a schematic perspective view of the footpeg assembly of FIG. 1A.

As shown in FIG. 9, in various examples, a footpeg assembly 900 may be secured to the bottom seat floor platform 112. The footpeg assembly 900 may comprise foot rests 902 and a footpeg connector 904. In various examples, the footpeg connector 904 may be slideably engaged with the bottom seat floor platform 112 such that the slots within the footpeg connector 904 match the rails 802 along the bottom seat floor platform 112. The slots in the footpeg connector 904 may take any shape such that the profile of the slots in the footpeg connector 904 matches the profile of the rails 802. For example, the rails 802 may be v-shaped and the slots in the footpeg connector 904 should dimensionally and geometrically match the v-shape of the rails 802. In various examples, the footpeg connector 904 may contain a hole, such that a locking mechanism, such as, but not limited to, a pin, can be placed in the hole of the footpeg connector 904 and engage with a hole in the rails 802. Therefore, the operator can adjust the position of the footpeg assembly 900 relative to the frame 102 by sliding the footpeg assembly 900 along the bottom seat floor platform 112 using the rails 802. When the operator has reached their preferred footpeg assembly 900 positon relative to the frame 102, the locking mechanism can be positioned through the footpeg connector 904 such that it engages with one of the holes on the rails 802, thereby preventing further movement of the footpeg assembly 900. In other various embodiments, the footpeg assembly 900 may be fixed along the bottom seat floor platform 112 using any fastener. The foot rests 902 may be secured to the footpeg connector 904.

Figure 10:
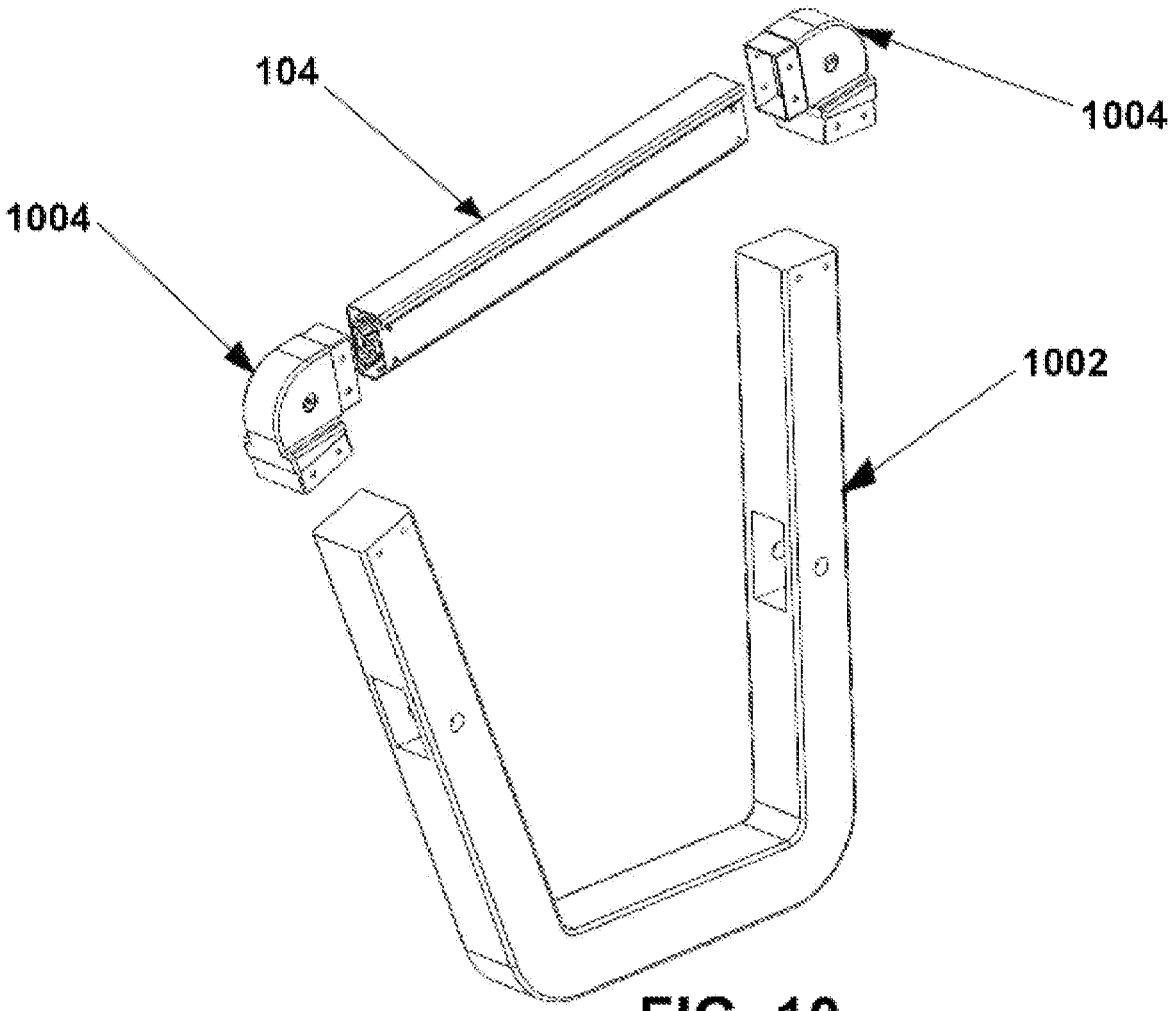
FIG. 10 illustrates an exploded side view of the frame of FIG. 1A.
Figure 11:
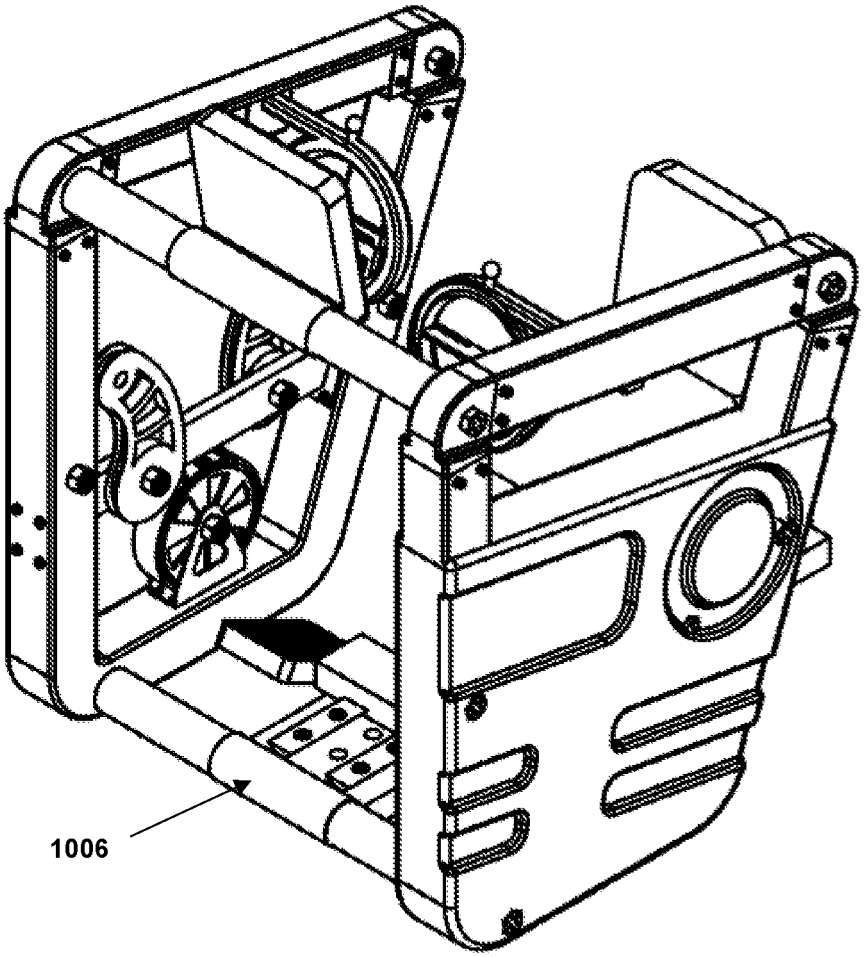
FIG. 11 is a rear perspective view of the exercise device of FIG. 1A.

In reference to FIGS. 10A and 10B, the frame 102 can be made from various solid materials such as, for example, metal, metal alloy, plastic, composite, or any combination thereof. The material can be suitable to withstand the forces exerted by the operator of the exercise device 100, such that the frame 102 does not break and/or crack upon use. The frame comprises supports and/or braces, such as, for example, the vertical supports 1002, corner supports 1004, and bottom supports 1006. The supports may be secured together.

Figure 14:
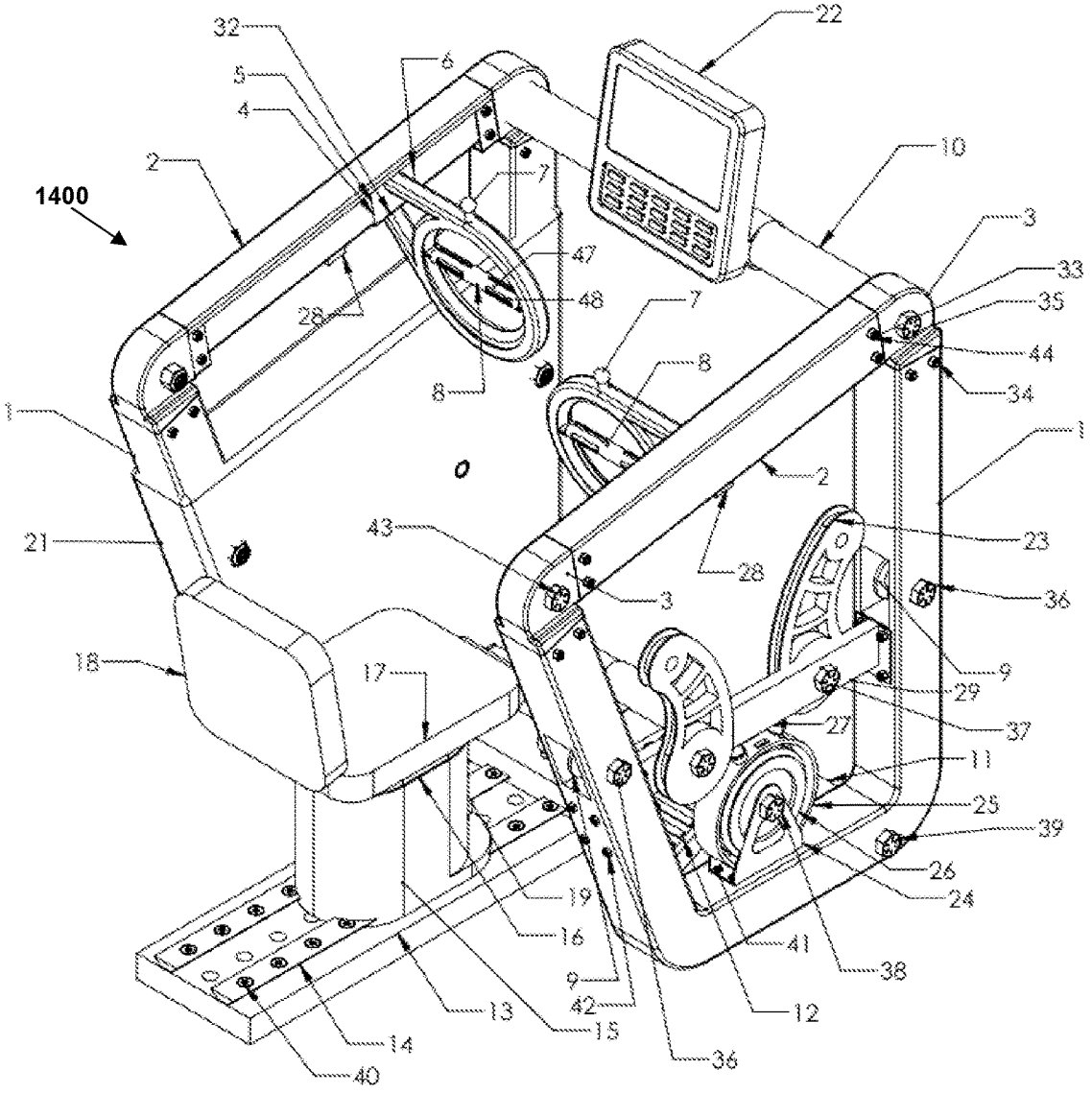
FIG. 14 is a perspective view of an exercise device according to the present disclosure.

Referring to FIG. 14, an example of an exercise device 1400 is provided. Exercise device 1400 can be configured substantially the same as exercise device 100. A description of each element for FIG. 14 is shown below:

1 Bottom Frame
2 Extrusion track
3 Elbow Bracket
4 Handle Track bracket
5 Wheels for track
6 Bearings for wheels
7 Lockpin for handle
8 Rotating handle
9 Pulley
10 Top Round Frame Tubing
11 Bottom Round frame tubing
12 Footpeg brackets
13 Bottom base for seat track
14 V-brackets for seat track
15 Seat bottom base
16 Seat Upper base
17 Butt Seat
18 Back Seat
19 Pull pin for seat adjustment
20 Right housing
21 Left housing
22 Computer with housing
23 Cam for cable pull
24 Bracket for mechanical resistance
25 Mechanical resistance housing
26 Flywheel for magnet resistance
27 Magnet adjustment assembly
28 Track Sensor
29 Cross bracket for Cams
30 Cable for pulling motion
31 Cable for pushing motion
32 Bolts for foot track
33 Bolts for extrusion to corner bracket
34 Bolts for extrusion to Side tubing
35 Bolts for upper tubing frame
36 Bolts for Pulleys
37 Bolts for Cams

38 Bolts for resistance wheels in housing
39 Bolts for lower Tubing frame
40 Bolts for seating track extrusion
41 Bolts for bracket of resistance housing
42 Cross beam mounting bolts
43 Top Rear Pulley mount bolt
44 Locknut 375 dia
45 Locknut 25 dia
46 Locknut 1 dia
47 Handle sensor plates for monitor
48 Battery AA for sensor handles As used herein, "intermediate" means that the referenced element is disposed between two elements but is not necessarily in contact with those elements. Accordingly, unless stated otherwise herein, an element that is "intermediate" a first element and a second element may or may not be adjacent to or in contact with the first and/or second elements, and other elements may be disposed between the intermediate element and the first and/or second elements.

One skilled in the art will recognize that the fasteners, structures, methods, operations/actions, and objects described herein, and the accompanying discussion, are non-limiting examples presented for the sake of conceptual clarity and that various modifications to the disclosed configurations are contemplated. Consequently, as used herein, the specific examples set forth, and the accompanying discussion, are intended to be representative of their more general classes. In general, use of any specific exemplar is intended to be representative of its class and the non-inclusion of specific components, devices, apparatus, operations/actions, and objects should not be taken as limiting. While the present disclosure provides descriptions of various specific aspects for the purpose of illustrating various aspects of the present disclosure and/or its potential applications, it is understood that variations and modifications will occur to those skilled in the art. Accordingly, the invention or inventions described herein should be understood to be at least as broad as they are claimed and not as more narrowly defined by particular illustrative aspects provided herein.

Any references herein to "various examples", "some examples", "one examples", "an example", a "non-limiting example", or like phrases mean that a particular feature, structure, or characteristic described in connection with the example is included in at least one example. Thus, appearances of the phrases "in various examples", "in some examples", "in one example", "in an example", "in a non-limiting example", or like phrases in the specification do not necessarily refer to the same example. Furthermore, the particular described features, structures, or characteristics may be combined in any suitable manner in one or more examples. Thus, the particular features, structures, or characteristics illustrated or described in connection with one example may be combined, in whole or in part, with the features, structures, or characteristics of one or more other examples without limitation. Such modifications and variations are intended to be included within the scope of the present examples.

In this specification, unless otherwise indicated, all numerical parameters are to be understood as being prefaced and modified in all instances by the term "about," in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described herein should at least be construed in light of the number of reported significant digits and by applying ordinary rounding techniques.

Also, any numerical range recited herein includes all sub-ranges subsumed within the recited range. For example, a range of "1 to 10" includes all sub-ranges between (and including) the recited minimum value of 1 and the recited maximum value of 10, that is, having a minimum value equal to or greater than 1 and a maximum value equal to or less than 10. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited. All such ranges are inherently described in this specification.

The grammatical articles "a", "an", and "the", as used herein, are intended to include "at least one" or "one or more", unless otherwise indicated, even if "at least one" or "one or more" is expressly used in certain instances. Thus, the foregoing grammatical articles are used herein to refer to one or more than one (i.e., to "at least one") of the particular identified elements. Further, the use of a singular noun includes the plural, and the use of a plural noun includes the singular, unless the context of the usage requires otherwise.

What is claimed is:

1. An exercise device comprising:
a frame;
a first track operatively coupled to the frame;
a first handle slideably engaged with the first track and configured to move from a first position relative to the first track to a second position relative to the first track, wherein the first position and the second position are different;
a second track operatively coupled to the frame;
a second handle slideably engaged with the second track and configured to move from a third position relative to the second track to a fourth position relative to the second track, wherein the third position and the fourth position are different;
a first force control device configured to adjust a first amount of force required to slide the first handle along the first track;
a second force control device configured to adjust a second amount of force to slide the second handle along the second track;
whereby the first handle and the second handle move independently of each other;
whereby the first amount of force and the second amount of force are independently controlled; and
wherein the first force control device comprises a magnetic resistance assembly.

2. The exercise device of claim 1, wherein the magnetic resistance assembly comprises a magnet and a flywheel, wherein a gap is present between the magnet and the flywheel and the gap is configured to create magnetic resistance to control the amount of force required to slide the handle along the track.

3. The exercise device of claim 2, wherein the magnetic resistance assembly is a first magnetic resistance assembly, the flywheel is a first flywheel, and the magnet is a first magnet, and further comprising:
a second magnetic resistance assembly, wherein the second magnetic resistance assembly comprises a second flywheel and a second magnet, wherein when the handle moves from the first position to the second position in a first direction, a first gap between the first flywheel and the first magnet creates a first magnetic resistance to control the amount of force required to slide the handle along the track in the first direction, and wherein when the handle moves from the second position to the first position in a second direction, a second gap between the second flywheel and the second magnet creates a second magnetic resistance to control the amount of force required to slide the handle along the track in the second direction.

4. The exercise device of claim 2, further comprising a motor wherein the motor is engaged with the magnet and activation of the motor moves the magnet and adjusts the gap between the magnet and the flywheel.

5. The exercise device of claim 4, further comprising a hardware control device comprising a display, a processor, memory, and buttons, and wherein the motor is configured to adjust the gap between the magnet and the flywheel responsive to a signal from the hardware control device.

6. The exercise device of claim 1, wherein each of the first and second handles comprises an inner handle loop rotatably engaged with and positioned within a swivel handle frame, wherein the inner handle loop is configured to rotate about the swivel handle frame.

7. The exercise device of claim 6, wherein each of the first and second handles further comprises a locking pin configured to engage with the inner handle loop and the swivel handle frame, wherein when the locking pin is engaged, the locking pin prevents the inner handle loop from rotating within the swivel handle frame.

8. The exercise device of claim 1, wherein the exercise device further comprises a moveable force translation device configured to translate force from the magnetic resistance assembly to the first handle.

9. The exercise device of claim 8, wherein the moveable force translation device comprises a cable, a belt, a chain, or a combination thereof.

10. The exercise device of claim 9, wherein the moveable force translation device comprises two belts, each belt providing resistance in a different direction.

11. A method of using the exercise device of claim 9, the method comprising:

urging the first handle from the first position to the second position; and urging the second handle from the third position to the fourth position.

12. The exercise device in claim 1, further comprising a seat operatively coupled to the frame.

13. The exercise device of claim 12, wherein the seat is adjustable.

14. The exercise device of claim 13, wherein the seat is positioned such that an operator sitting in the seat can urge the first handle from the first position to the second position with a press motion.

15. The exercise device of claim 1, wherein the first track and the second track are linear.

16. The exercise device of claim 15, wherein the first force control device comprises a first magnetic resistance assembly and the second force control device comprises a second magnetic resistance assembly magnetic resistance assembly and the second force control device comprises a magnetic resistance assembly, and the exercise device further comprises a plurality of belts, wherein a first set of two of the belts are configured to translate force from the first force control device to the first handle and a second set of two belts are configured to translate force from the second force control device to the second handle.

* * * * *